US005471957A

United States Patent [19]

Brady et al.

[11] Patent Number: 5,471,957

[45] Date of Patent: Dec. 5, 1995

[54] COMPACT BOILER HAVING LOW $NO_X$ EMISSIONS

[75] Inventors: Robert T. Brady, Elmhurst; Joseph H. Werling, Mundelein, both of Ill.

[73] Assignee: Mark IV Transportation Products Corporation, Niles, Ill.

[21] Appl. No.: 210,841

[22] Filed: Mar. 18, 1994

Related U.S. Application Data

[60] Division of Ser. No. 972,358, Nov. 5, 1992, Pat. No. 5,333,574, which is a continuation-in-part of Ser. No. 760, 023, Sep. 11, 1991, Pat. No. 5,259,342.

[51] Int. Cl.[6] ..... F22B 23/06

[52] U.S. Cl. ..... 122/367.1; 110/345; 110/347; 110/234; 236/15 E; 431/76

[58] Field of Search ..... 110/345, 347, 110/234; 122/367.1; 236/15 E; 431/76

[56] References Cited

U.S. PATENT DOCUMENTS 5,259,342 11/1993 Brady et al. ..... 122/367.1
5,333,574 8/1994 Brady et al. ..... 122/367.1

*Primary Examiner*—Henry A. Bennet
*Assistant Examiner*—Siddharth Ohri
*Attorney, Agent, or Firm*—Francis J. Lidd

[57] ABSTRACT

Method and apparatus for reducing the NOX levels in stack emissions of compact boilers and fluid heaters through selective injection of exhaust flue gases into the combustion process. Flue gas injection into the primary and secondary air of the burner along with flue gas injection directly into the combustion process is utilized. Injection of generated steam from a compact boiler, selectively injected into the combustion process is also provided.

3 Claims, 8 Drawing Sheets

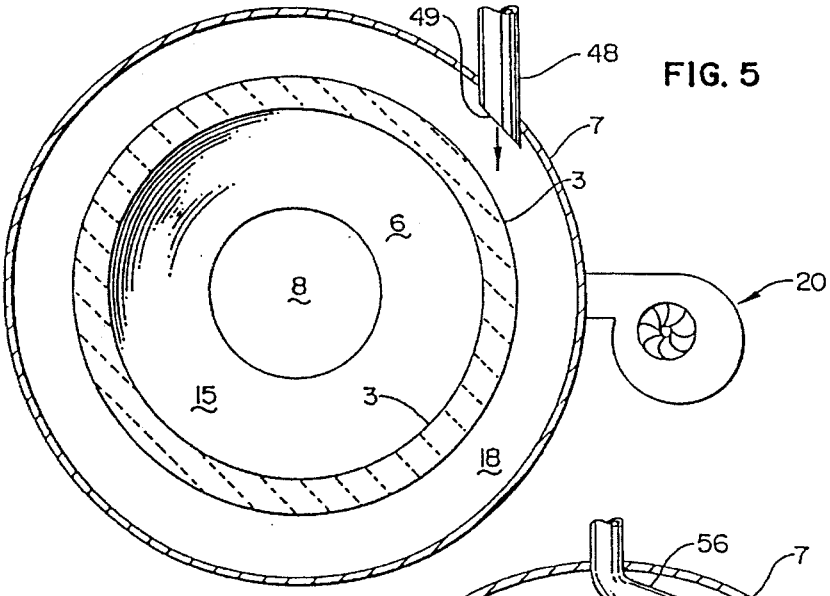
FIG. 5
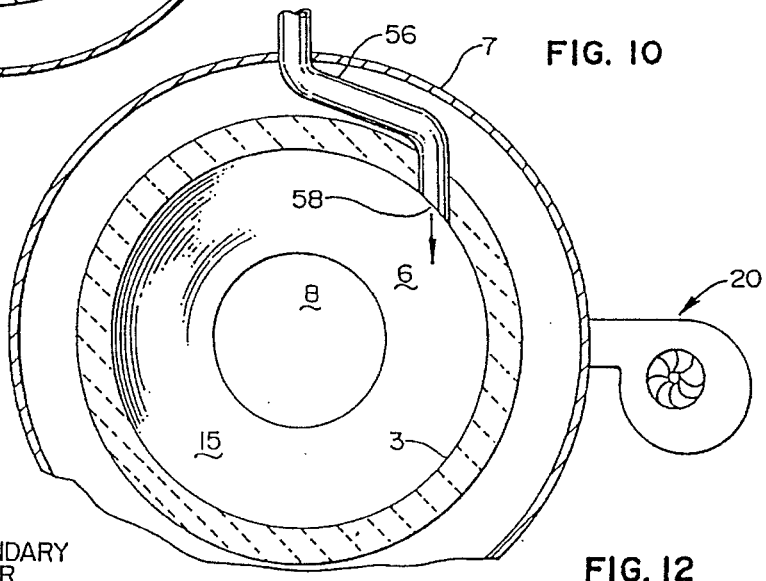
FIG. 10
FIG. 11
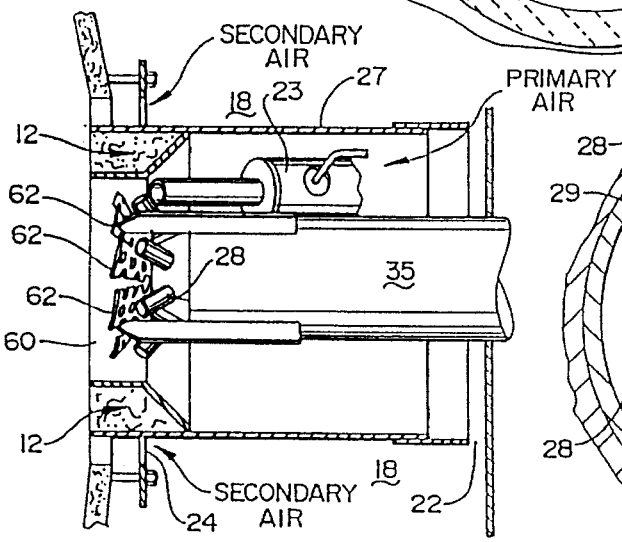
FIG. 12
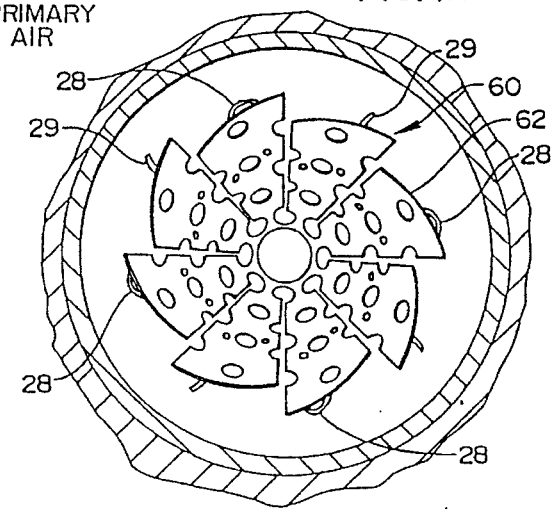

100
75
50
25
NOx CONTENT IN % OF MAXIMUM
(MIN)
(MAX)
1
2
3
4
5
6
7
8
9
B
BOILER FIRING RATE

FROM STEAM OUTLET 19
64
AMBIENT AIR
44
FLUE GAS
TO ATMOSPHERE
CAPTURED
FLUE GAS
43
45
42
46
FLUE
GAS
X1
17
48
7
FLUE GAS
EXITING
COILS
49
63
10
6
15
4
X1
61
8
31
GASEOUS
FUEL
30
52
18
3

18

PRIMARY
4 AIR
7
18
3
SECONDARY
AIR
65
STEAM
25
23
28
26
31
35
28
28
22
24
FLUE
GAS
SECONDARY
AIR
27
18
30
18

7
22
24
25
26
28
29

COMPACT BOILER HAVING LOW $NO_X$ EMISSIONS

CROSS REFERENCE TO RELATED APPLICATIONS

This application is a divisional of application Ser. No. 07/972,358, filed on Nov. 5, 1992, now U.S. Pat. No. 5,333,574, which is a continuation-in-part of application Ser. No. 07/760,023, filed on Sep. 11, 1991, now U.S. Pat. No. 5,259,342.

BACKGROUND OF THE INVENTION

This invention relates generally to combustion of gaseous fuels wherein the NOX content in products of combustion or flue gases are reduced to acceptable levels. More particularly, this invention relates to low NOX combustion systems for gaseous fuel fired compact boilers and similarly fired fluid heating devices.

In the above-mentioned copending application, a system of controlling flue gas NOX content through controlling the ratios of injected flue gas, and ambient air, into the primary combustion air. In that application the flue gas is scavenged or intercepted in the boiler exhaust through the use of a novel bell mouthed duct. Final control of the NOX boiler outlet gas emissions is achieved through sensing low NOX level downstream of the flue gas tap.

Although the above-mentioned system is creditable, applicants in continuing investigation have discovered additional methods for reducing NOX, particularly in the "compact" boiler designs. The invention disclosed herein provides a method for reducing NOX in boiler stack emissions that is less complex, easier to adjust and is lower in cost than earlier systems.

Therefore, it is an object of this invention to provide a method and apparatus for reducing the NOX level in compact boiler stack emissions.

It is an additional object of this invention to provide a method and apparatus for reducing compact boiler NOX levels in stack emissions through controlling flue gas injection into the primary and secondary air inputs to the boiler or heater.

It is another object of this invention to reduce the NOX content of compact boiler emissions through control of mixed tertiary air and flue gas injection into the boiler combustion chamber.

SUMMARY OF THE INVENTION

The method and apparatus disclosed herein utilizes a standard compact boiler burner and combustion system. Flue gas or combustion products exiting the heat exchange portion of a compact boiler is mixed with predetermined quantities of ambient or combustion air, and injected into the combustion process through use of a flue gas blower Apportioned quantities of flue gas, ambient air, and mixtures of these are injected into the boiler combustion process.

In a first embodiment, a flue gas/ambient air mixture exiting the flue gas blower is injected in controlled amounts into the boiler combustion air plenum, and the burner primary air channel.

In an alternate embodiment, the mixture of flue gas and ambient air exiting a flue gas blower is injected directly into the combustion chamber of the compact boiler such that mixing of the injected flue gas and the ongoing combustion process is achieved.

An additional improvement utilized in NOX reduction includes improved fuel/air mixing at the burner outlet.

BRIEF DESCRIPTION OF THE DRAWINGS

FIG. 5 is a section along the lines of 5—5 of FIG. 2, particularly showing the location of flue gas injection into the combustion air plenum and location of the primary combustion air blower.

FIG. 10 is a section along the lines 10—10 of FIG. 6, particularly showing the location and configuration of the flue gas injection duct and its entry orifice in the inner periphery of the boiler refractory combustion chamber.

FIG. 11 is a cross sectional showing an alternate embodiment of the burner of FIGS. 2 and 7, particularly showing a modified flame spinning/spreading/flame holding cone of the invention.

FIG. 12 is a section along the lines 12—12 of FIG. 11, particularly showing details of the modified flame spreading/holding cone of the invention in its relationship to the gaseous fuel nozzles.

While the flue gas recirculated combustion system of the invention disclosed herein will be described in connection with certain preferred embodiments and methods, it will be understood that it is not intended to limit the apparatus and system disclosed to that embodiment or method. On the contrary, it is intended to cover all alternatives, modifications and equivalents as may be included within the spirit and scope of recirculated flue gas injection into combustion systems of compact boilers as defined by the appended claims.

DETAILED DESCRIPTION OF THE INVENTION

As the invention disclosed herein is primarily concerned with boilers of the compact variety having characteristics distinctly different from conventional steam boilers and/or fluid heaters, the following general description will address operation of the boiler in conjunction with the flue gas recirculating system. Subsequent description will, in much greater detail, discuss the operation and structure of applicants' novel flue gas recirculating system. However, to impart a basic understanding of compact boiler operation of the type disclosed herein, it is necessary to refer to FIG. 1. It should be noted that the portions of the boiler closely associated with the invention disclosed herein will be depicted by symbols referred to in the discussion. Other elements largely included to complete applicants disclosure of the compact boiler of the invention will be described by written legends as shown. The terminology of these written legends is, as those skilled in the art will readily recognize, composed of terminology of long standing and wide acceptability in the boiler and liquid heater arts.

An additional and widespread use of the heater configuration disclosed is supplying heat to remote locations by circulating high temperature fluids. The heat transfer fluids utilized have boiling temperatures as high as 600° F. with relatively low vapor pressures. In operation, these units have no appreciable fluid vaporization, and are termed "liquid phase" heaters.

Figure 1:
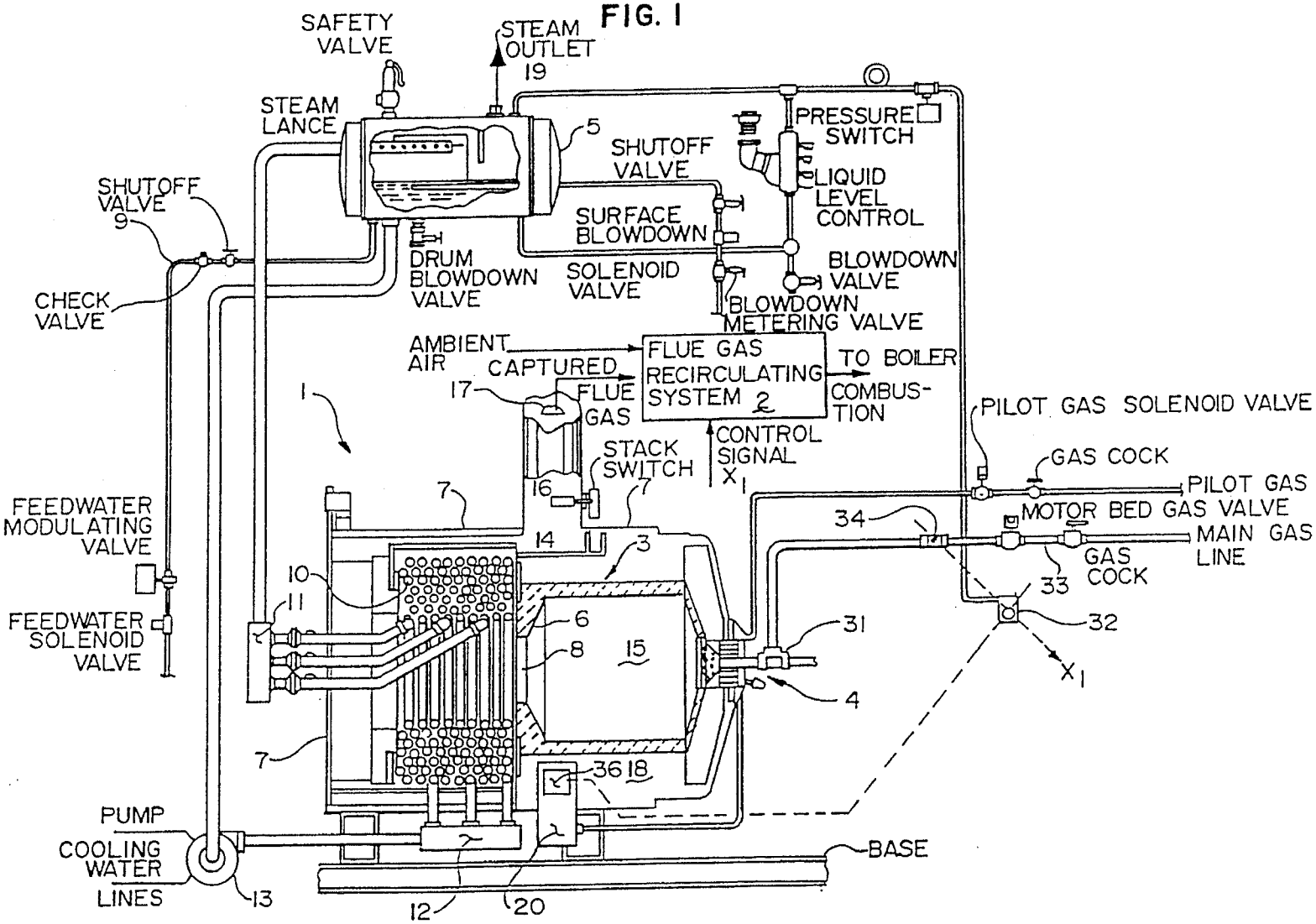
FIG. 1 is a semi-schematic and diagrammatical section view of a "typical" compact boiler of the invention, in particular, shown are connections to fuel and feed water inputs, combustion gas outlets and a view of the entire burner-combustion chamber structure juxtaposed in a heat transfer relationship with the steam generating or fluid heating coils. Also shown are the outlet steam pressure control, combustion air, and fuel inlet valves.

Therefore, in particular reference to FIG. 1, there is shown a boiler assembly 1 having an outer shell 7 containing a refractory combustion chamber 3 having an inner volume 15 and, at its inlet end, a burner assembly 4, and, at its outlet end, a combustion choke 6 and outlet 8. In fluid communication with the combustion outlet 8 is a coil tube bank 10 through which combustion gases generated in the chamber 15 flow outward into the combustion gas plenum 14 and from there to the atmosphere through the boiler outlet or stack 16. Located in the stack 16 is a stack gas capture device or scoop 17, and duct 40 which supply flue gas to the recirculating system 2. As discussed above, this system 2 comprises a major portion of the invention disclosed herein and will be discussed in much greater detail. Also included in the boiler operation is a steam drum 5 supplied with feed water by a water supply inlet 9. Water level in the drum is maintained as shown by a water level control. Feed water, maintained at a typical level as shown is recirculated from the steam drum 5 by recirculating pump 13 through coil bank inlet manifold 12. After feed water exits the manifold 12 and passes through tube bank 10, now heated to a predetermined temperature and pressure, the water exits the coil banks through manifold 11, passes into the steam drum and is sprayed via a steam lance into the drums as shown. Since the pumped water exiting the steam lance is above its saturation temperature, much of it flashes into steam which is delivered to an associated system having steam demand via the steam outlet as shown. Return water enters the drum and is recirculated via the pump 13.

Combustion control is accomplished through the use of a steam pressure actuator 32 operating in conjunction with variable gas flow valve 34 controlling combustion gas flow from supply 33 to burner inlet 31, and further controlling combustion air blower damper control 36. In operation, pressure associated with the steam outlet representing steam demand is applied to the pressure actuator 32 which in turn adjusts the firing rate and combustion air blower in accordance with a predetermined ratio of fuel/air over a predetermined firing range of the unit. Signals representing the particular firing range associated with an additionally particular steam demand are thereby available for operating elements of the flue gas recirculating system which will now be described in detail. Similar control of liquid phase heaters would be related to thermal load reflected in return fluid temperature drop instead of steam pressure.

Figure 2:
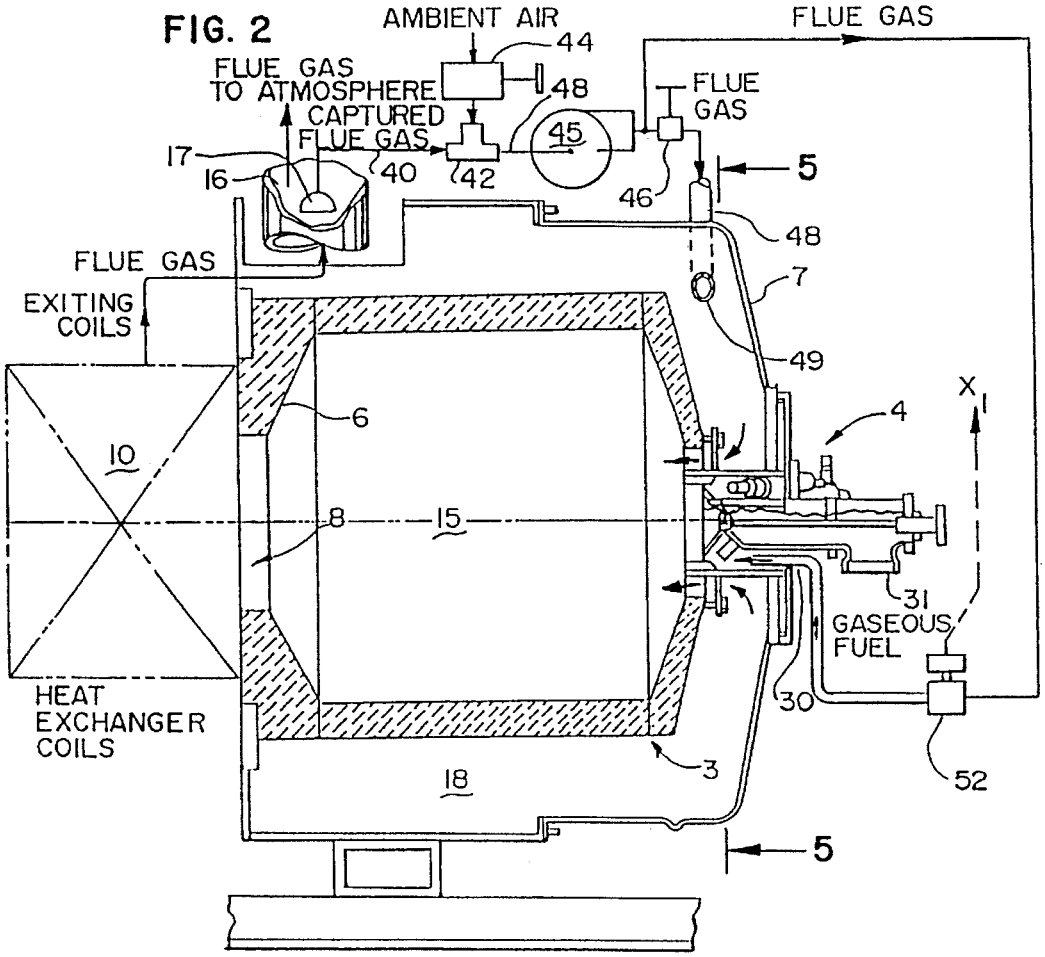
FIG. 2 shows a first embodiment of the invention in diagrammatic, semi-pictorial section, particularly showing the relationship of recirculated flue gas injected into the burner and combustion air plenum. The structural relationship between the boiler combustion chamber and burner are also shown.

In particular reference to FIGS. 2 and 5, a preferred embodiment of the flue gas recirculating system (FGR) 2 of FIG. 1 is shown in detail. As shown in FIG. 2, a portion of the flue gas exiting the heat exchange system 10 via the outlet stack 16 is captured by a scoop 17, carried by duct 40 to tee 42 and further carried by duct 43 to the inlet of flue gas blower 45. The tee 42 combines flue gas with ambient air controlled by valve 44 with flue gas entering the blower 45. Flue gas exiting the blower 45 travels through control valve 46 through injecting duct 48 and enters the compact boiler plenum 18 via flue gas exit orifice 49. Additional amounts of flue gas exiting the blower 45 are carried via duct 50 through control valve 52 and burner inlet duct 50 to the burner outer shell 27 of the burner assembly 4 via inlet port 30. As the burner shell 27 is contained intermediate the boiler outer shell 7 and combustion chamber wall 3 with primary and secondary air ports 22 and 24, respectively, supplied from plenum 18, the flue gas injection via 30 provides a flue gas/primary air mixture within the burner outer shell 27. Also shown within the shell 27 is a pilot assembly 23.

Figure 3:
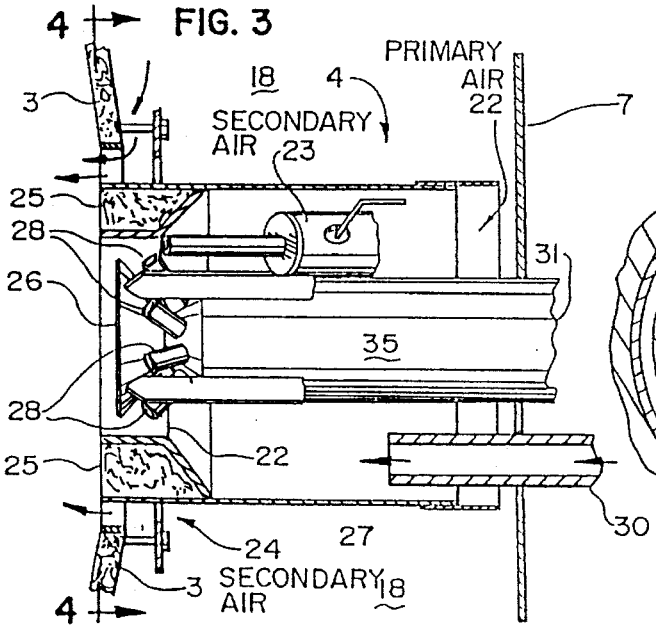
FIG. 3 is an enlarged cross-section of the burner of FIG. 2 including its mounted location internal of the combustion air plenum, and particularly showing the primary air flue gas injection port.
Figure 4:
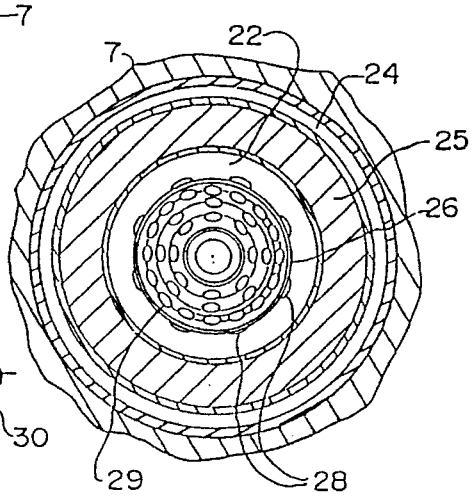
FIG. 4 is a section along the lines of 4—4 of FIG. 3, particularly showing the flame holding cone and gaseous fuel nozzle locations.

Burner assembly 4 further consists of a gas tube 35 fed with gaseous fuel gas via inlet means 31. In continuing reference to FIG. 3 and FIG. 4, annular secondary air inlets 24 are shown. Also shown is a virtual annular primary air inlet orifice 22 defined by mounting the burner end of blast tube 35 within a circular inlet orifice, i.e., defined by an annular flame holder ring 25 including a combustion assembly comprised of a series of gaseous fuel nozzles 28 peripherally radiating from the end of gas tube 35. Also attached to the end of gas tube 35 is a flame spreading conoidal ring member 26. As shown in FIG. 4 the flame spreading member further contains a multiplicity of flame holding orifices 29.

In operation, gaseous fuel entering the burner assembly 4 via inlet 31 exits the combustion end of gas tube 35 via nozzles 28. With the nozzles positioned as shown concentrically mounted within the burner outer shell 27, a mixture of primary air entering orifice 22, and gaseous fuel exiting nozzles 28 are mixed and ignited by the pilot assembly 23. Combustion gases are then propelled into the combustion chamber 5. Secondary air entering combustion chamber 5 contributes to combustion therein. Since flue gas entering the inlet port 30 also mixes with the primary air internal of an annular space defined by the outer surface of gas tube 35 and the inner surface of outer shell 27, flue gas mixing occurs in the combustion process at the point of gaseous fuel entrance into the combustion process.

Figure 15:
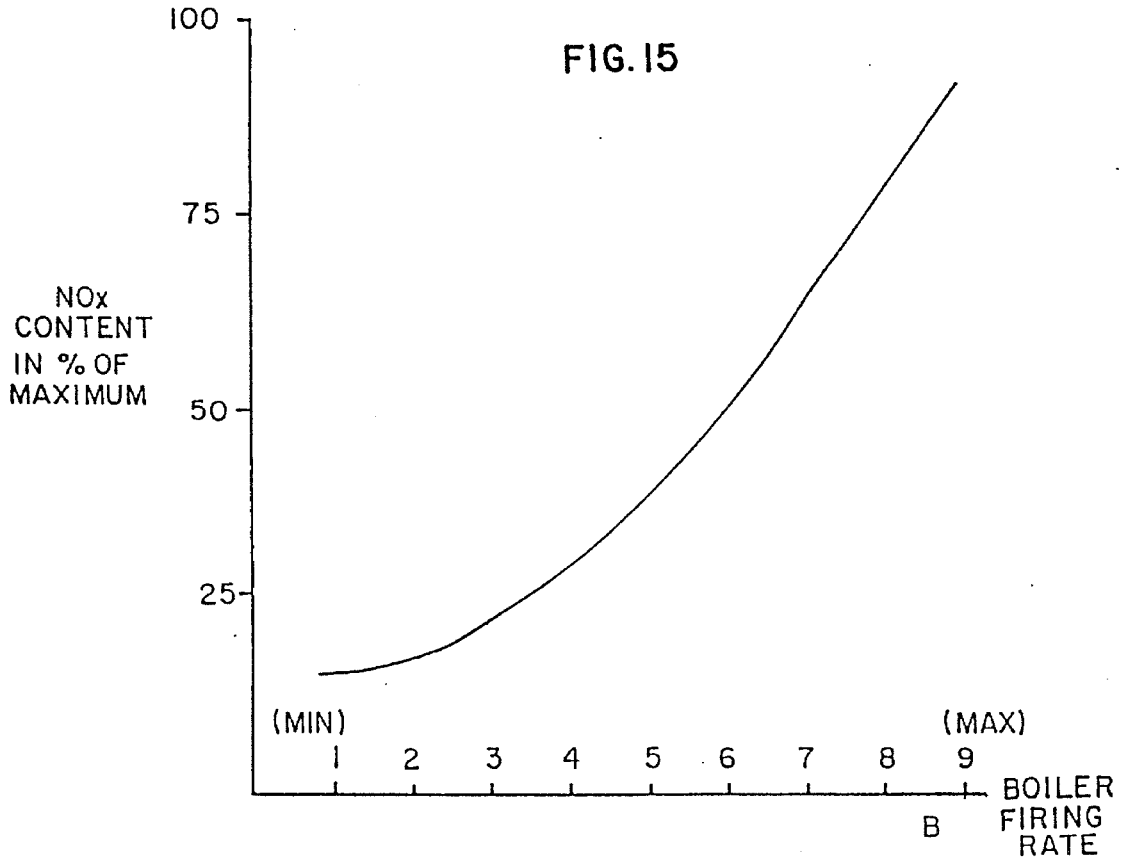
FIG. 15 is a graphical depiction of the boiler emission NOX content utilizing the injection systems of the invention for the entire firing range of the compact boiler disclosed.

Applicants have discovered, as shown in FIG. 15, that injecting properly controlled amounts of flue gas in both the combustion air plenum 18, and simultaneously into the burner primary air mixing annulus 19 provides a substantial reduction in the NOX content of gases exiting the heat exchange section and entering the stack 16.

The essential nature and location of flue gas injection into the combustion air plenum 18 is shown in FIG. 5. As shown, flue gas enters the chamber 18 via duct 48 and orifice 49 flowing tangentially (as shown) in the annular inter-space between the outer surface of chamber 3 and the boiler outer shell 7. Also shown is the approximate location of a combustion air blower 20 mounted so as to inject ambient combustion air into the annular space 18.

Typically, in a compact boiler of the size found to be widely accepted in the marketplace, approximately 22% of the total flue gas stack flow would be recirculated, gas flow apportioned between the burner and combustion plenum approximately 14% and 86%, respectively, of the total. It should be noted that these figures are maximum recirculation at maximum boiler output, the control system utilized in the invention apportions these in varying amounts as determined by the boiler or heater firing rate, which in turn, as indicated earlier, is controlled by the output steam demand or heater thermal load.

Figure 6:
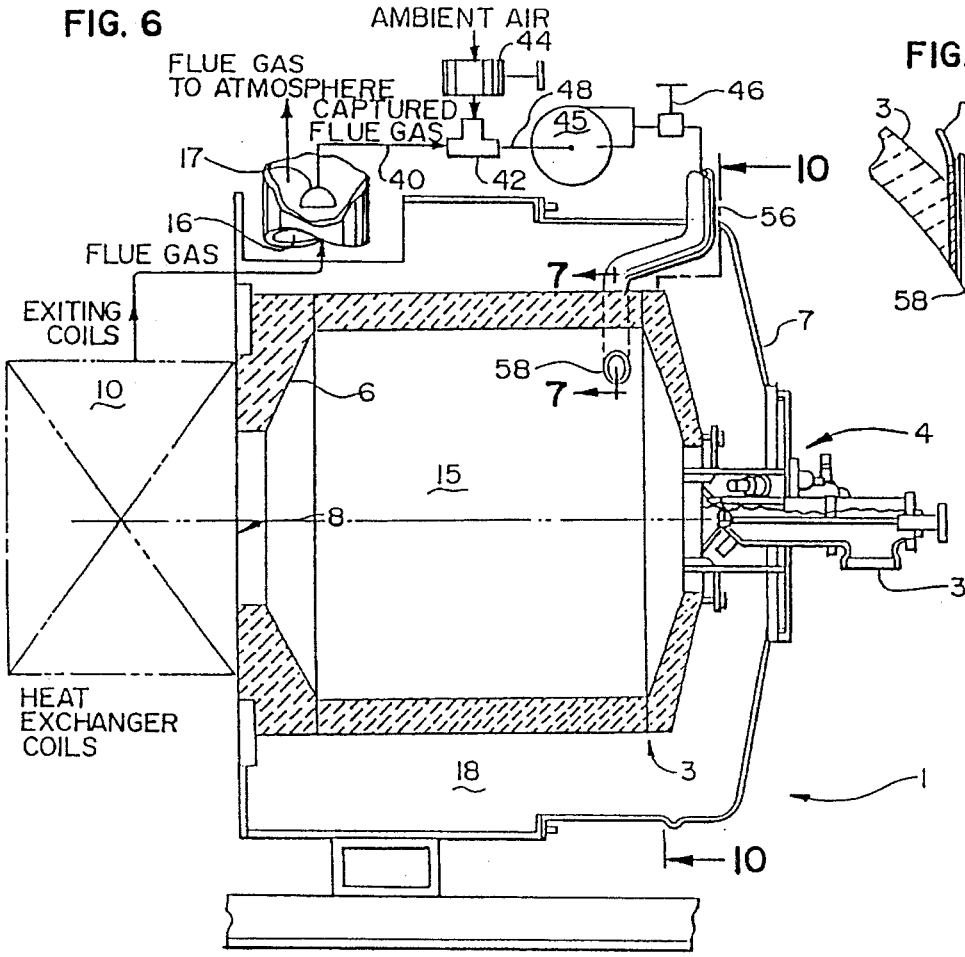
FIG. 6 is a diagrammatic semi-pictorial representation of an alternate embodiment of the invention, particularly showing flue gas recovery, and flue gas injection into the combustion chamber of the boiler.
Figure 7:
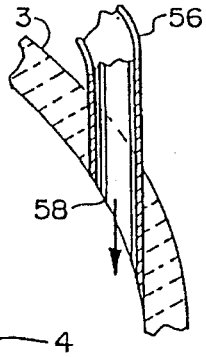
FIG. 7 is a partial section through the line 7—7 of FIG. 6 particularly showing the structure used to inject flue gas into the boiler combustion chamber.

An alternate embodiment of the invention is particularly shown in FIG. 6. As in Xthefirst embodiment, a controlled amount of flue gas exiting the boiler exhaust stack 16 is carried via ducts 40 and 43, through mixing tee 42, adding ambient air through valve 44, into the inlet of FGR blower 45. However, in a distinct departure from the first embodiment, flue gases exiting the blower 45 pass through the annular combustion air plenum 18 and enter the combustion chamber 15 directly through duct 56 and combustion chamber inlet orifice 58. With reference to FIG. 7, the method of tangentially injecting flue gas into the combustion process is shown by the location of orifice 58 where duct 56 enters the wall of combustion chamber 3.

Figure 8:
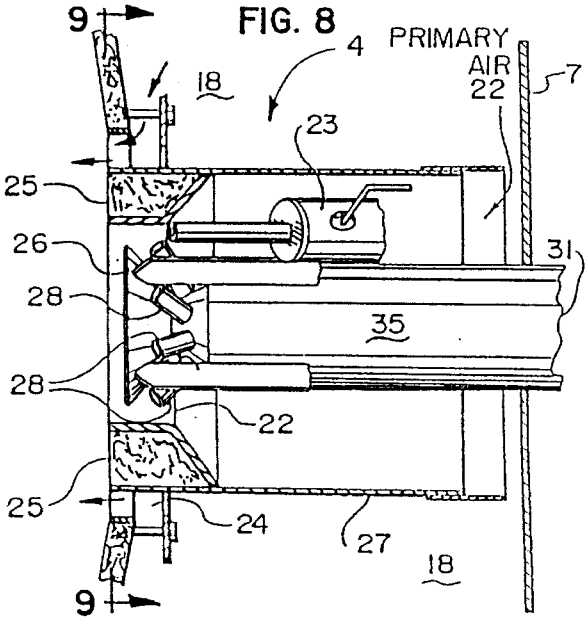
FIG. 8 is an enlarged section through the burner of FIG. 6, particularly showing the flame holding, flame spreading cone, gaseous flue nozzles, and annular secondary air ports.
Figure 9:
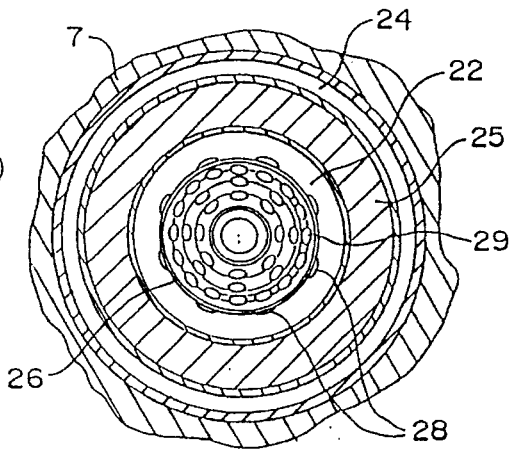
FIG. 9 is a section through lines 9—9 of FIG. 8 showing the conical flame stabilizing/flame holder cone of the burner and gaseous fuel nozzles.

In FIG. 7, the location of flue gas inlet orifice 58 is shown in section, entering the combustion chamber 15 in a flow pattern tangential to the chamber inner surface, thereby providing improved mixing of recirculated air flue gas mixture now added directly into the combustion process. FIGS. 8 and 9 show in complete detail the burner of the invention as described earlier.

An additional embodiment of the invention disclosed, is shown in FIGS. 11 and 12. With particular reference to FIG. 12, there is shown essentially the burners of FIGS. 3 and 8, however, incorporating an improved flame spinning cone 62. As shown, cone 62 has been reconfigured to provide a plurality of angularly twisted or offset vanes aligned so as to impart a spinning motion into the mixture of gaseous fuel, primary air and flue gas exiting the burner head assembly annular outlet orifice 22. The use of vanes arranged and located as shown further increases the reduction in NOX emissions through improved flue gas fuel and air mixing prior to entering the combustion process.

Figure 13:
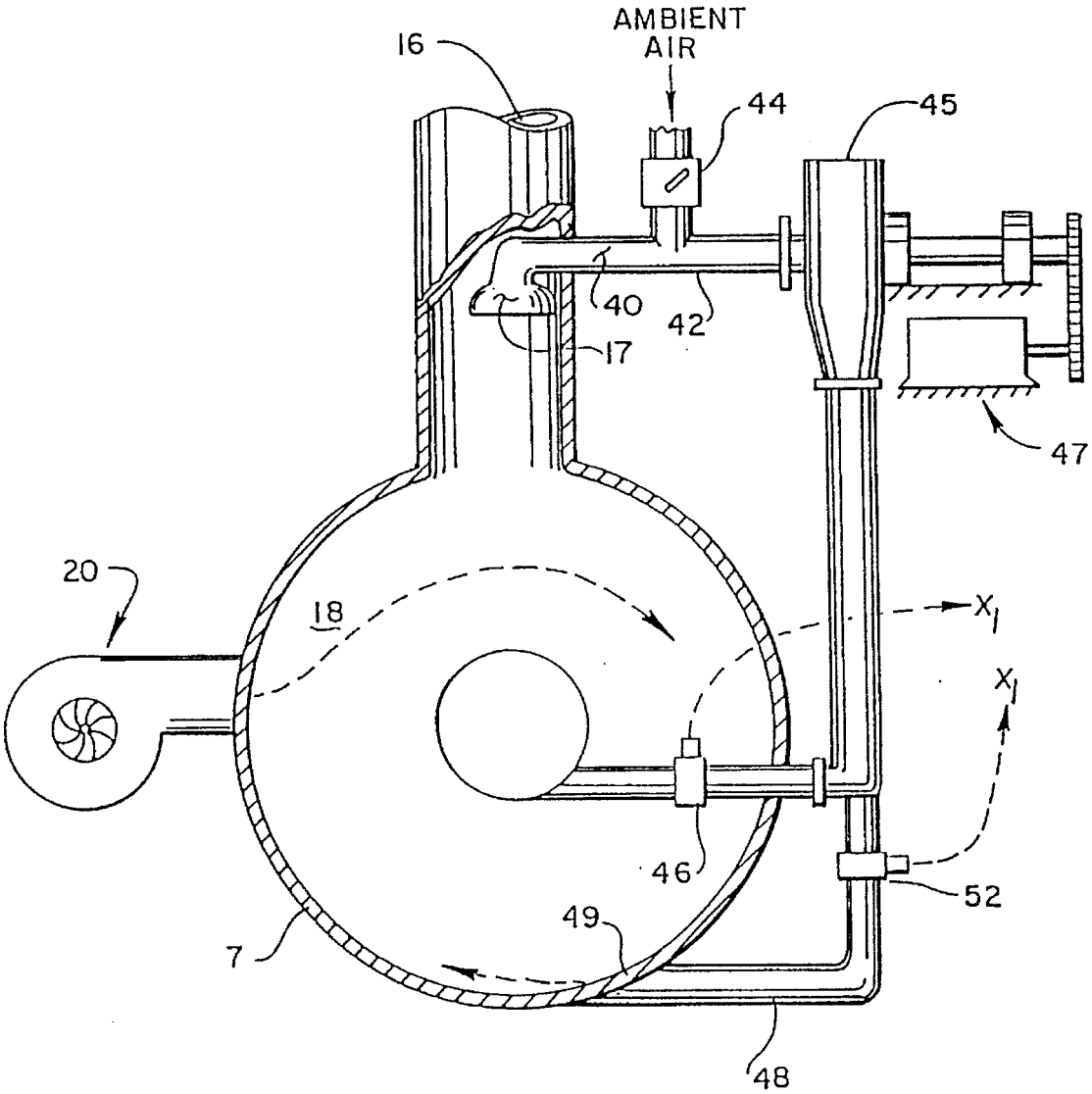
FIG. 13 is a semi-diagrammatical, semi-pictorial representation of the flue gas injection system of the boiler shown in FIG. 2, more particularly showing the flue gas scoop and interceptor duct, blower, and location of the blower outlet ducting utilized to control and inject flue gas into the primary burner combustion air and boiler combustion air plenum.

A more detailed depiction of the flue gas recirculating system of the first embodiment is shown in FIG. 13. As shown, combustion air entering the stack 16 and scoop 17 travels through duct 4 where it is mixed with predetermined amounts of ambient air via control valve 44 in mixing tee 42 thereby entering the inlet of blower 45 driven by drive means 47. Flue gas exiting the blower 45 at increased pressure enters the combustor outer shell 27 via control valve 46. Similarly, flue gas flowing through inlet duct 48 is controlled by valve 52. Ambient combustion air is introduced to the plenum 18 by blower 20, as shown.

It should be noted that both control valves 46 and 52 are actuated by delivered steam pressure via actuator 32. With this system, amounts of gaseous fuel, combustion air exiting combustion blower 20, flue gas recirculated through valves 46 and 52 are optimumally proportioned to provide required steam at the boiler outlet 19 while limiting the NOX content over the firing range as shown by FIG. 15.

Figure 14:
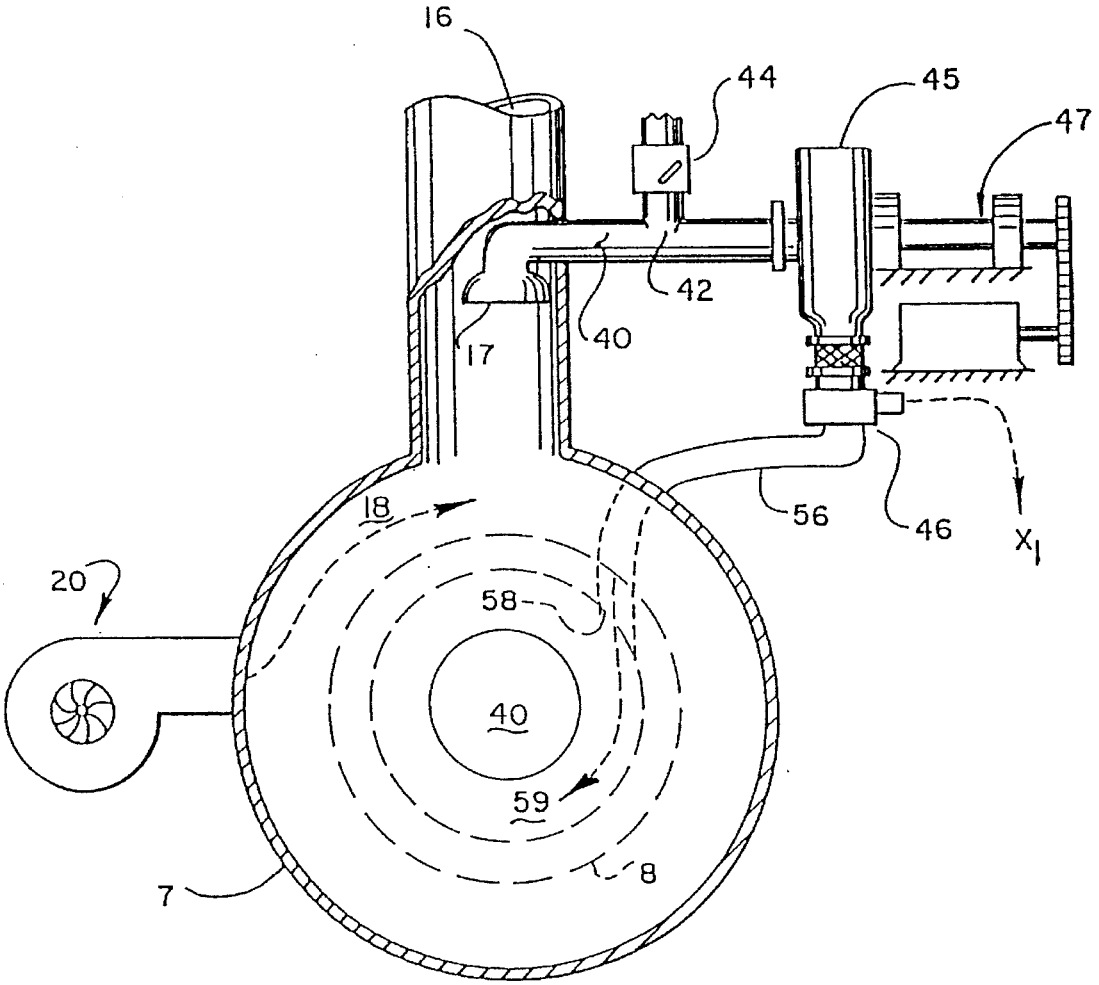
FIG. 14 is a semi-diagrammatical, semi-pictorial view of the flue gas recirculating system of the invention, similar to that of FIG. 13, however, particularly showing flue gas exiting a flue gas blower and location of flue gas direct injection into the combustion chamber of the boiler.

Similarly, FIG. 14 provides a semi-diagrammatic depiction of the flue gas control system of the first alternate embodiment wherein combustion air exiting blower 20 passes through the annular combustion air plenum 18 defined by the combustion chamber outer surface 3 and the boiler shell 7 as shown. Flue gas captured via scoop 17 in stack 16 is mixed with ambient air controlled by valve 44 at tee 42, and enters the inlet of combustion air blower 45 via duct 40. FGR blower 45 is controlled by a drive assembly 47.

The flue gas/ambient air mixture exits combustion air blower 45 at increased pressure, passes through control valve 46 into duct 56 and is injected directly into the combustion chamber 15 via tangential inlet orifice 58, initiating a flow pattern 59.

Figure 16:
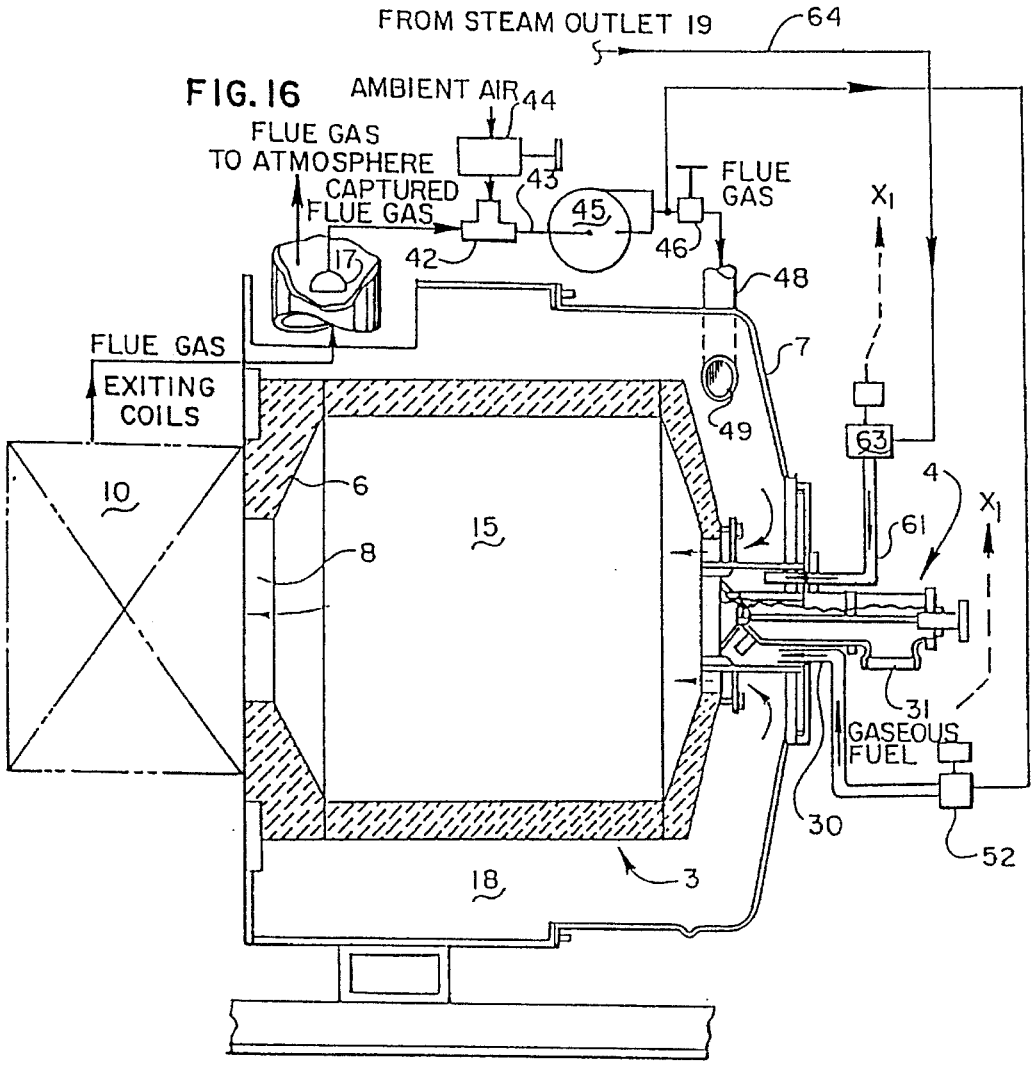
FIG. 16 is a semi-pictorial cross-sectional view of the boiler of the invention similar to FIG. 2, however, particularly showing the use of steam injection into the burner shell.
Figure 17:
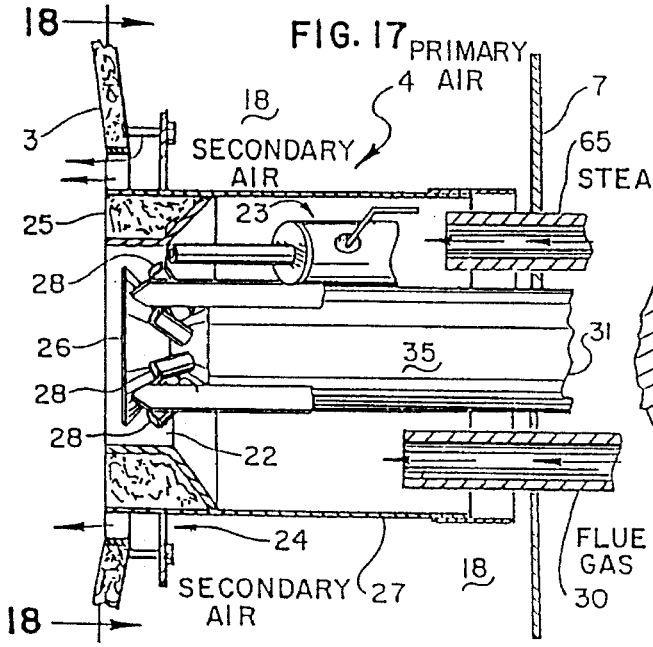
FIG. 17 is an enlarged cross-sectional view of the burner assembly of FIG. 16, particularly showing steam injection into the burner shell.
Figure 18:
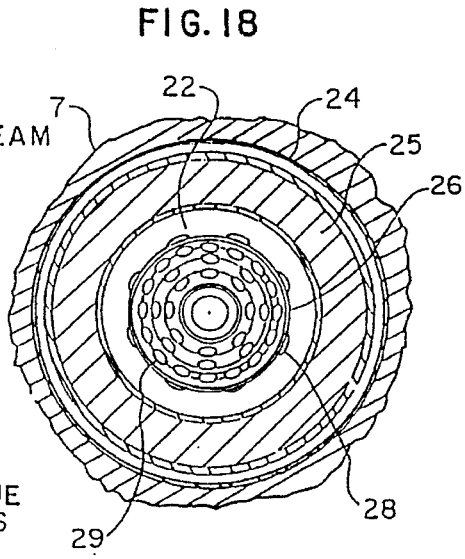
FIG. 18 is a cross-sectional view along the lines 18—18 of FIG. 17 showing additional views of the burner construction.

A further embodiment of the invention is shown on FIGS. 16, 17 and 18. Disclosed in these figures is applicants' further discovery that in the case of a compact steam boiler, injection of boiler output steam from the drum 5 via outlet 19 further reduces the NOX content of the boiler flue gas emitted to the atmosphere.

With particular reference to FIGS. 16 and 17, there is shown a boiler having the flue gas recirculating system of FIG. 2, however, including steam injection at the burner primary air inlet.

As shown, steam from outlet 19 (reference FIG. 1) via steam line 64 passes through control valve 63 and enters the burner via conduit 61. With particular reference to FIG. 17, the controlled steam exiting valve 63 passing through conduit 61 enters the burner shell 27 at the steam injector 65.

In a "typical" steam generator of a popular size and capacity, steam injection as shown comprises approximately 1.5%–2.46% of the total maximum boiler steam delivery to a given load.

As shown in conjunction with flue gas recirculation, applicants submit that utilizing steam injection is, therefore, an important advancement in the art of NOX reduction, particularly for compact boilers of the type disclosed herein.

As indicated above, applicants have discovered that recirculating combustion flue gas by injecting gases at certain heater locations corresponding to critical points in the combustion processes of a compact fluid heater have provided reductions in NOX content of stack gases as required by recent environmental considerations.

Applicants further discovery that injecting properly controlled amounts of steam into the combustion process via the burner primary air is a further low cost, easy to adjust, and effective method of reducing NOX content in the stack emissions of a compact boiler.

The novel and inexpensive approaches disclosed herein are easy to adjust, low cost, and conforms to existing emission regulations with a minimum of boiler redesign.

Thus, it is apparent that there has been provided in accordance with the invention, modifications in a compact boiler resulting in reducing NOX levels in boiler exhaust gases, that fully satisfy the objects, aims and advantages set forth above.

While the flue gas and steam recirculating systems and apparatus disclosed have been described in conjunction with specific embodiments thereof, it is evident that many alternatives, modifications and variations will be apparent to those skilled in the combustion arts and in the light of the foregoing description. Accordingly, it is intended to embrace all such alternatives, modifications, and variations as may fall within the spirit and broad scope of the appended claims.

What is claimed as new and desired to be secured by Letters Patent of the United States are:

1. A method of reducing the NOX level in stack gas exhaust from a compact fluid heater for supplying heat according to thermal load demand, said heater having a combustor for generating heat including high temperature flue gas, heat exchange means for extracting heat from said combustor, and an exhaust stack for discharging flue gas to the atmosphere comprising the steps of:

utilizing a burner in said combustor for generating heat and flue gas, said combustor having gaseous fuel and primary and secondary air inputs;

capturing a controlled, predetermined amount of said flue gas;

apportioning said captured flue gas among said primary and secondary inputs;

injecting said apportioned flue gas amounts into said primary and secondary inputs;

controlling said apportioned flue gas in accordance with gaseous fuel input as required by heater load demand.

2. The method of claim 1 further comprising the steps of utilizing said heat exchange means to generate steam;

extracting a controlled amount of said steam from said heat exchange means; and apportioning said steam among said primary and secondary air inputs.

3. A method of reducing the NOX level in stack gas exhaust from a compact fluid heater for supplying heat according to thermal load demand, said heater having a combustor for generating heat including high temperature flue gas, heat exchange means for extracting heat from said combustor, and an exhaust stack for discharging the flue gas to the atmosphere comprising the steps of:

utilizing a burner in said combustor for generating heat and flue gas, said burner having gaseous fuel and primary and secondary air inputs;

incorporating means for circulating fluid through said heat exchange means;

generating steam from said circulating fluid;

capturing a controlled, predetermined amount of said generated steam;

apportioning said captured steam among said primary and secondary inputs;

injecting said apportioned steam in controlled amounts into said primary and secondary inputs;

controlling said controlled amounts of said steam in accordance with gaseous fuel input as required by heater load demand.

* * * * *